US005988596A

United States Patent [19]

Mitchell et al.

[11] Patent Number: 5,988,596

[45] Date of Patent: Nov. 23, 1999

[54] CABLE FOUL SENSOR DEVICE FOR WINCHES

[75] Inventors: Michael Mitchell, Easton; Wayne Trenery, Effort, both of Pa.

[73] Assignee: Trans Technology Corporation, Liberty Corner, N.J.

[21] Appl. No.: 09/075,482

[22] Filed: May 11, 1998

[51] Int. Cl.[6] ..... B66D 1/48

[52] U.S. Cl. ..... 254/271; 254/277; 254/383

[58] Field of Search ..... 254/269, 271, 254/272, 273, 277, 278, 380, 383

[56] References Cited

U.S. PATENT DOCUMENTS

| | | | |
|---|---|---|---|
| 647,242 | 4/1900 | Sprague . | |
| 813,451 | 2/1906 | Rohlfing et al. . | |
| 1,163,165 | 12/1915 | Mueller . | |
| 2,019,512 | 11/1935 | Stahl . | |
| 2,053,976 | 9/1936 | Stahl . | |
| 2,489,913 | 11/1949 | Logan . | |
| 2,502,710 | 4/1950 | Duncan | 254/271 |
| 2,683,020 | 7/1954 | Nickle | 254/271 |
| 3,031,169 | 4/1962 | Robinson et al. . | |
| 3,056,586 | 10/1962 | Burrows | 254/271 |
| 3,182,961 | 5/1965 | Le Bus . | |
| 3,901,479 | 8/1975 | Arnold | 254/271 X |
| 3,994,476 | 11/1976 | Van Gennep . | |
| 4,165,863 | 8/1979 | Schreyer | 254/277 |
| 4,213,019 | 7/1980 | Houp . | |
| 4,448,394 | 5/1984 | Le Moine . | |
| 5,186,283 | 2/1993 | Salmon | 254/271 X |
| 5,271,608 | 12/1993 | Kubono | 254/269 |
| 5,335,895 | 8/1994 | Sell . | |

FOREIGN PATENT DOCUMENTS

| | | | |
|---|---|---|---|
| 1252294 | 8/1986 | U.S.S.R. | 254/383 |

*Primary Examiner*—Donald P. Walsh
*Assistant Examiner*—Emmanuel M. Marcelo
*Attorney, Agent, or Firm*—Weingram & Associates, P.C.

[57] ABSTRACT

A cable foul sensor device for winches includes a flapper plate extending from a cover for the cable drum, and a sensing finger extending along the edge of the flapper plate to terminate above an upper layer of cable wound on the drum. The flapper plate is connected to a pivot member through which an adjustable set screw is mounted. A stationary housing for spring loaded switches is mounted on the cover and includes a contact plate which is depressed downward by the set screw of the pivot member to force the switches to the closed position to provide power for the drum. Upon fouling of the cable at the drum, the cable foul will displace the sensing finger and the flapper plate which will cause the pivot member to pivot away from the actuator plate, thereby permitting the spring loaded switches to bias in the open position to interrupt power to and lock the drum. An audio and/or visual signal is provided to indicate that a cable foul at the drum has occurred.

13 Claims, 4 Drawing Sheets

CABLE FOUL SENSOR DEVICE FOR WINCHES

BACKGROUND OF THE INVENTION

1. Field of the Invention

The present invention relates to winches and hoists used in aircraft and in particular, to cable hoist systems adapted for use in a helicopter to sense cable fouling, control the disposition of the cable with respect to the drum, and signal cockpit personnel that fouling has occurred.

2. Description of the Related Art

There are many ways in which a cable can be fouled at the cable drum. For example, cable used with winch drums can be fouled by parting of the cable, kinks in the cable or an excessive amount of slack in a standing portion of the cable. During reeling operations, the cable can become loosened on the drum and foul. A broken strand of wire from the cable will force successive layers of cable out of alignment with respect to the drum, thereby causing the cable to foul on the drum.

In helicopters, a cable is more susceptible to fouling due to the heavy vibrations which occur on the aircraft's fuselage. Exposure of the fuselage to the vibrations requires that the winch assembly and cable be particularly adapted to operate in the "choppy" environment caused during helicopter operations.

It is therefore especially important to be able to sense immediately when a cable has fouled to prevent irreparable damage to the cable and the winch, and harm to personnel in the immediate area if the cable should part. Just as important is that a cable foul sensor device be able to distinguish between the vibrations in the fuselage of the helicopter, and an actual cable foul which will adversely impact on cable operations.

Cable winding safety devices are known in the elevator and well drilling arts. For example, U.S. Pat. No. 641,242 to Sprague discloses a cable winding safety device having a bar which lies parallel with and close to the face of a cable drum so that the space between the cables will be considerably less than the height of the ridges of the drum with the thickness of the cables. When cables climb out of their groove, the bar is forced back to coact with a switch arm above the drum to open the switch and stop the drum.

U.S. Pat. No. 813,451 to Rohlfing et al discloses a safety device for hoisting mechanisms which is used to control or stop the main hoist of the motor when the hoisting limit has been reached. The device consists of a rocking lever disposed at an interior of the drum and from which a trip-pin extends to project out of the drum. A trip pawl is mounted to coact with the other end of a rocking lever and be forced to extend from the drum to contact a switch when the trip-pin has been forced downward against the rocking lever by the cable being wound around the drum and down upon the trip-pin.

U.S. Pat. No. 1,163,165 to Mueller discloses a safety device for elevators consisting of a flexible metal strip, wire or bar arranged in proximity to a cable drum and extending longitudinally along said drum and spaced therefrom. A loose or broken strand of cable will make contact with the safety device for an electro-responsive controlling device to trip the switch controlling the drum.

U.S. Pat. No. 2,019,512 to Stahl discloses a means for preventing reverse winding of a cable on a drum, which device consists of a latch lever having a land stop and a groove stop which ride along the cable and grooves of the drum to actuate a stop switch when the cable has been taken out from the drum, or when a sufficient amount of cable has been wound upon the drum.

U.S. Pat. No. 2,053,976 to Stahl discloses a detent means for cable drums consisting of a recess in the first turn of the guide groove of the drum and in which a detent lever is arranged to lie in the recess and is pivotally carried by means of a pivot pin secured to the body. When the last turn of cable has been unwound off the drum, further movement of the drum will cause the arm to signal all the cable has been unwound.

U.S. Pat. No. 2,489,913 to Logan discloses a hoist control mechanism consisting of a pair of rocker arms which coact with a roller and control cam on the drum to control movement of the drum.

U.S. Pat. No. 3,031,169 to Robinson et al discloses an apparatus for automatically controlling drilling, which consists of an auxiliary control unit operable by valve means to which a pressure line is connected. The auxiliary control unit senses movement of the drum.

U.S. Pat. No. 3,182,961 to Le Bus discloses a combined fleet angle compensator and braking apparatus consisting of an eccentric shaft along which a sheave guard member moves. A braking mechanism is spaced from the eccentric shaft and is provided with a braking plate member adapted to engage the outer periphery of the cable spooled on the drum in the braking position. Upon release of tension in the cable, the braking plate is moved into contact with the outer layer or wrap of cable upon pivotal movement of the arm 24 to prevent slack in the cable from fouling on the drum.

U.S. Pat. No. 3,994,476 to Van Genneup discloses an automatic arrangement for a windlass to prevent unwanted reverse rotation of such windlass. The device consists of a load sensing lever arm, with one end pivotally mounted to the housing and the other end extending to support a pulley for the windlass block and tackle. Brake pressure is applied when the sensing lever succumbs to a particular amount of downward force resulting from the load thereon.

U.S. Pat. No. 4,213,019 to Houp discloses an overhead door cable safety device consisting of a U-shaped monitoring arm disposed in a spaced relationship adjacent to a top of the cable wrapped around a cable drum. Movement of the monitoring arm upward against the biasing of springs closes a switch to signal that the cable has been disengaged, unraveled, or frayed.

U.S. Pat. No. 4,448,394 to LeMoine discloses a high low safety apparatus for drilling rigs consisting of a pair of longitudinally moveable stems at opposed sides of a cable drum, each of the stems having a hemispherical surface which are normally positioned spaced from the cable on the drum. Movement of the hemispherical surface of the stem moves a valve element to allow passage of air through the valve to stop actuation of the drum.

U.S. Pat. No. 5,335,895 to Sell discloses a sensing rope guide for a hoist drum consisting of a split steel ring joined at the top by a steel hinge and held together at the bottom by a spring and bolt which encircle at least a portion of the drum. Steel groove rollers are housed in pockets of the ring to contact a sensing valve. If travel over the ring along the hoist drum is impeded by resistance from a side pull acting on the retainer and arm, or resistance from some other cause acting at some other point on the ring, the groove rollers cam out to actuate the sensing valve and prevent further operation of the hoist in the same direction.

However, among the devices disclosed in the patents above, none are especially adapted for use in aircraft, such as helicopters, and the particular environmental conditions these machines operate in. The heavy vibration of a helicopter fuselage requires the need for a cable foul sensing device which is immediately responsive to a cable foul at the drum, yet will not inadvertently be tripped due to the heavy vibration that the cable drum and cable are exposed to.

SUMMARY AND OBJECTS OF THE INVENTION

To overcome the disadvantages of known cable safety devices and to accomplish the objectives identified below, there is provided a cable foul sensor device for aircraft, and especially helicopter winches which includes: means for rotating the cable drum, means for switching power to the rotating means, means for sensing irregular movement of the cable with respect to the cable drum, and means for controlling the power switching means, the controlling means responsive to movement of the sensing means and being adapted for movement between a closed position for power to be switched to rotate the cable drum, and an open position to prevent power from being switched to the drum and means to screen out and distinguish vibrations and other spurious activity which might give false cable fouling signals. Means are provided for adjusting the sensitivity of the device.

It is an object of the present invention to provide a cable hoist with cable foul sensor device for helicopters which is immediately mountable to a helicopter fuselage and which senses and reacts to cable fouling.

It is another object of the present invention to provide a cable foul sensor device which is retrofittable to cable hoists installed in helicopters.

It is another object of the present invention to provide a cable foul sensor device which is operable in an environment of heavy vibration, such as experienced aboard helicopters.

It is another object of the present invention to provide a cable hoist sensor device which controls operation of a cable hoist drum in a heavy vibration environment, and which is adapted to distinguish between vibrations and actual cable fouling at the drum.

It is another object of the present invention to provide a cable foul sensor device of a size conducive to mounting in the confined space of a helicopter hoist housing.

It is another object of the present invention to provide a cable sensor device which detects cable fouling and immediately stops rotation of the cable drum.

It is another object of the present invention to provide a cable sensor device which actuates the winch brake for the drum sufficient to hold the load on the cable in the stopped position.

It is another object of the present invention to provide a cable sensor device which signals operators of the device and the aircraft that the cable has fouled at the drum.

It is another object of the present invention to provide a cable sensor device retrofittable to the cover for the drum.

It is another object of the present invention to provide a cable sensor device having duplicate switch housings to enhance reliability and accuracy of operation.

It is another object of the present invention to provide a cable sensor device having multiple hermetically sealed switches mounted in series to provide sensitive and reliable operation of the device.

It is another object of the present invention to provide a cable sensor having a wiring assembly with a harness for quick release connection to the electronics of the aircraft, which can be retrofitted into existing wiring systems for cable hoists.

It is another object of the present invention to provide a cable sensor having a switch assembly which is wired in the open position, yet forcefully held in the closed position for system operation so that tripping of the switches secures power to the system very quickly.

It is another object of the present invention to provide a cable foul sensor device which is reliable in all environments of operation by the aircraft or helicopter.

It is another object of the present invention to provide a cable foul sensor device which is lightweight and durable for use in the harsh conditions to which aircraft and helicopters are exposed.

It is another object of the present invention to provide a cable foul sensor device which is easy to operate and maintain.

It is another object of the present invention to provide a cable foul sensor device which has elements thereof exposed for easy identification and access for maintenance and repair.

It is another object of the present invention to provide a cable foul sensor device which is resistant to accidental actuation.

It is another object of the present invention to provide a cable foul sensor device which actuates easily and is immediately actuable in response to cable fouling at the drum.

It is another object of the present invention to provide a cable foul sensor device which is adjustable to accommodate the different tensions required for the particular switching assembly used for the cable drum.

BRIEF DESCRIPTION OF THE DRAWINGS

For a more complete understanding of the present invention, reference may be had to the following description of exemplary embodiments of the present invention taken in connection with the accompanying drawings, of which.

DETAILED DESCRIPTION OF THE PREFERRED EMBODIMENTS

Figure 1:
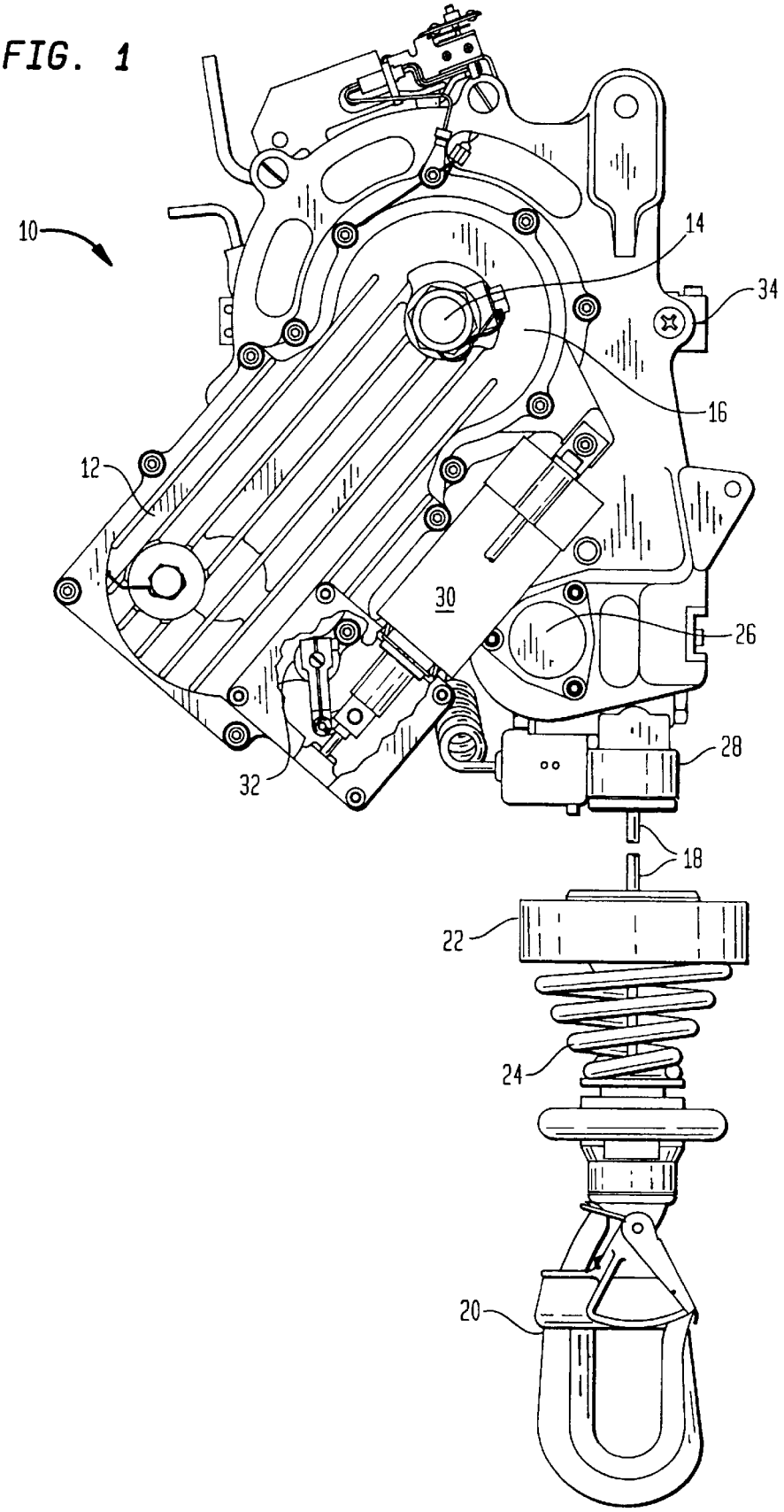
FIG. 1 shows a preferred embodiment of the cable foul sensor device for winches according to the present invention.

Referring to FIG. 1, a cable foul sensor device of the present invention is shown generally at 10. The device 10 is constructed with a winch assembly or can be retrofitted to a cable hoist or winch which are used extensively in helicopters. A housing 12 or cowling is disposed about the cable hoist.

The cable hoist includes a shaft 14 around which a drum 16 rotates to reel in or reel out cable 18. One end of the cable 18 is provided with an attaching means 20, such as a pelican hook. A cushionable bumper 22 is attached to the cable 18 and spaced from the end of the cable to which the hook 20 is attached. A spring 24 is arranged on the cable 18 between the hook 20 and the bumper 22. The spring 24 compresses with the bumper 22 to prevent the hook 20 from being wound onto the drum 16 and absorb shock should over-winding occur of the cable 18 onto the drum 16.

The cable 18 is guided onto and off of the drum 16 by the coaction between a level wind screw 26 and an anti-friction cable guide 28. The cable guide 28 is mounted to the level wind screw 26, which is chain driven off the drum 16 to move the level wind screw 26 and the cable guide 28. The level wind screw 26 coacts with the movement of the drum 16 so that as the level wind screw 26 turns, the cable guide 28 moves linearly along the level wind screw 26 to guide the cable 18 evenly onto or off of the drum 16.

The level wind screw 26 extends in spaced relation across a length of the drum 16 and receives a coacting member of the cable guide 28 to control travel of the cable guide 28 along the level wind screw 26. The rotational movement of the level wind screw 26 causes the cable guide 28 to travel linearly therealong to guide the cable 18 evenly onto or off of the drum 16. In either operation of reeling in or reeling out of the cable 18, the operation is by power only, as there is no free rotational movement of the drum 16.

Figure 2:
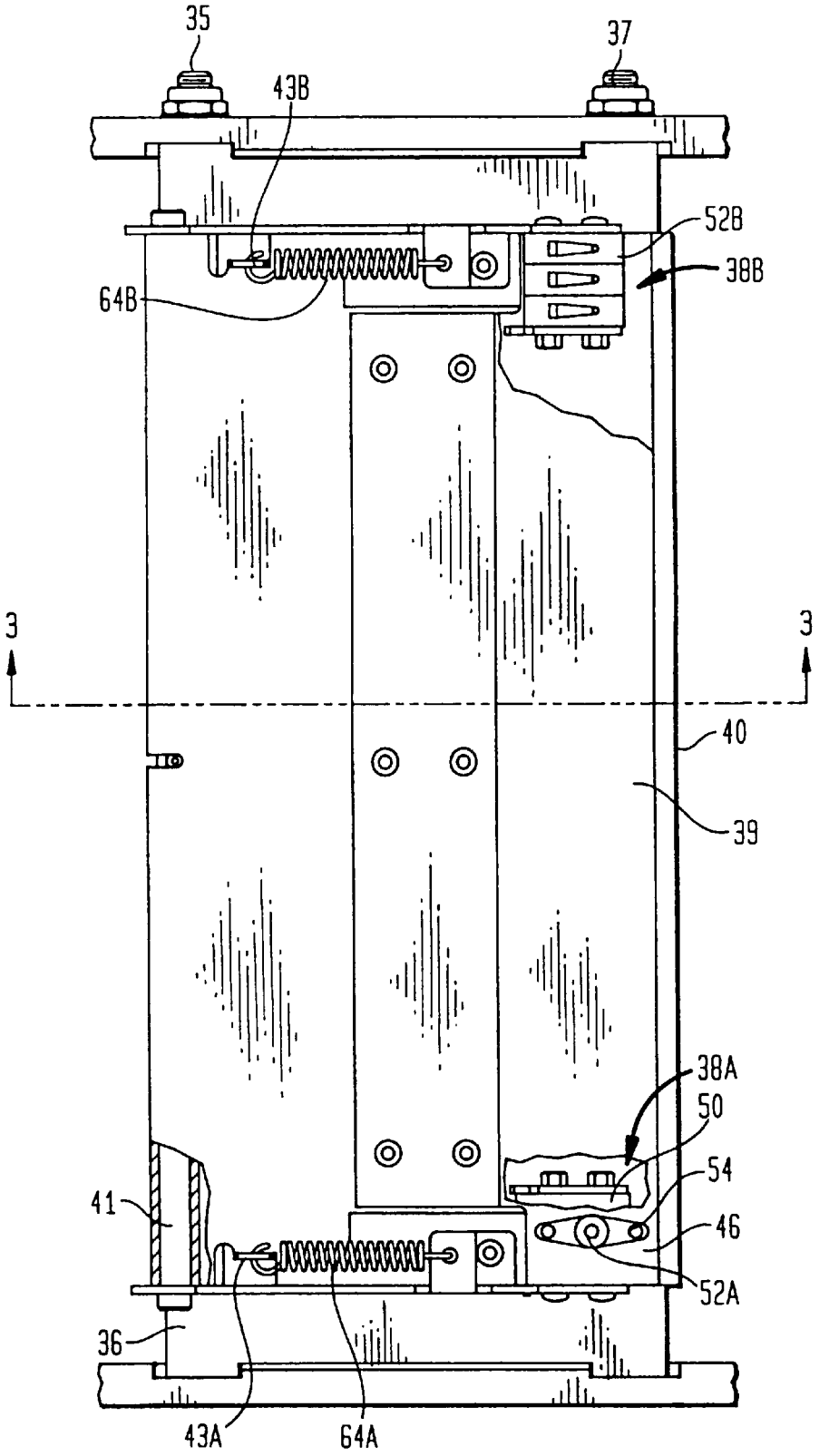
FIG. 2 is another view of a portion of the device shown in FIG. 1.
Figure 4:
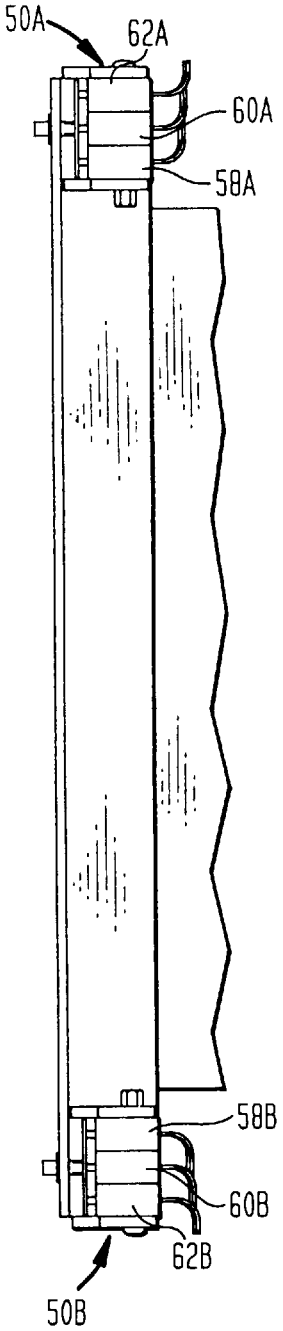
FIG. 4 is a view of switches used in the present invention.
Figure 3:
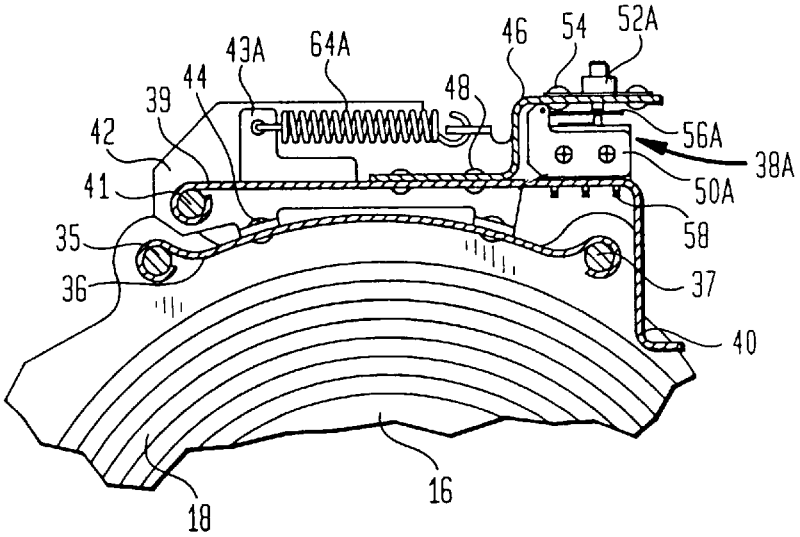
FIG. 3 is a view of the present invention taken along line 3—3 in FIG. 2.

Referring also to FIGS. 2–4, the device 10 includes a motor 30 to operate a drive assembly 32, such as a chain drive or gear drive, to turn the shaft 14 about which the drum 16 rotates. The drum 16 includes a series of individual grooves (not shown) into which a first layer of the cable 18 is disposed so that successive layers of the cable 18 are layered evenly after the first cable winding. As many as five layers of the cable 18 can be wound onto the drum 16, although additional layers can be wound upon the drum 16 provided it is constructed of a size sufficient to accommodate the additional layers. A guard rail 34 extends across an open face of the drum 16.

Referring in particular to FIGS. 2 and 3, further elements of the cable sensor device 10 are disclosed. As shown in FIG. 2, a cover 36 is disposed at an exterior of the drum 16 a sufficient distance from an area in which the cable 18 is wound about the drum 16. The cover 36 is secured in position by studs 35,37 which span the width of the drum 16. As shown in FIG. 3, the cover 36 has opposed ends which wrap around a corresponding one of the studs 35,37 to hold the cover in position. The cover 36 tends to enclose the cable winding on the drum for safety purposes. Control switch assemblies generally indicated at 38A,38B, are disposed at opposed sides of the drum and mounted on the cover as shown in FIG. 2.

A flapper plate 39 extending along a length of the drum 16, has a sensing finger 40 which extends into the opening in front of the cover. The flapper plate 39 is pivotally mounted to a bar 41, which extends through a bracket 42, which bracket is mechanically fastened to the cover 36 with rivets 44.

An actuating strip 46 is fixed by rivets 48 to the flapper plate 39. The actuating strip 46 is bent to form a space in which switch housings 50A,50B at opposed sides of the drum 16 are accessible. Brackets 43A,43B are connected to the flapper plate 39. Adjustable set screws 52A,52B extend through each end of the actuating strip 46 in registration with a corresponding one of the switch housings 50A,50B. The set screws 52A,52B are mounted to the actuating strip 46 by rivets 54, and are adjustable.

Referring to FIGS. 3 and 4, the switch housings 50A,50B each include an actuator plate 56A,56B, respectively displaceably mounted to the housings 50A,50B to be contacted and forced downward by a corresponding one of the set screws 52A,52B extending through the actuating strip 46, to thereby contact simultaneously and pressure spring loaded switches 58A,B; 60A,B; 62A,B into a closed position. Accordingly, circuitry is closed for power to be switched to the drum 16 by displacement of the actuating or contact plates 56A,56B against the respective switches. The set screws 52A,52B are adjustable for providing the correct amount of displacement to the actuator plates 56A,56B.

Springs 64A,64B each have one end connected to the actuating strip 46, and have the other end connected to a corresponding one of the brackets 43A,43B. The springs 64A,64B bias the actuating strip 46 and hence, the sensing finger 40 downward and toward the cable drum.

The downward biasing of the springs 64A,64B urges the actuating strip 46 toward the drum with a force sufficient to withstand the effects of vibration to which the helicopter is exposed. This construction is especially well adapted so that vibrations and other shocks exerted on the aircraft during operation are not able to falsely actuate or trip the sensing finger 40 and the actuating strip 46 to falsely signal a cable foul. The springs 64A,64B therefore function to filter the unstable actions normally experienced when a helicopter is operating, so that the cable drum can operate under the effect of the vibrations and the circuitry not be "tripped" or opened continuously under false actuation.

As shown in FIG. 4, the switch housings 50A,50B are arranged at opposed sides of the flapper plate 39 so that cable fouling, regardless of its position with respect to the drum 16, is immediately sensed and responded to. The switch housing 50A includes three limit switches 58A,60A, 62A, while the switch housing 50B includes three limit switches 58B,60B,62B, which when tripped, immediately move into the open position to interrupr power to the drum 16, which automatically engages the brake for the drum 16, and signals in the cockpit that such has occurred. The limit switches 58A,60A,62A,58B,60B,62B are for the DOWN stop, the UP stop, and the signal light.

Figure 5:
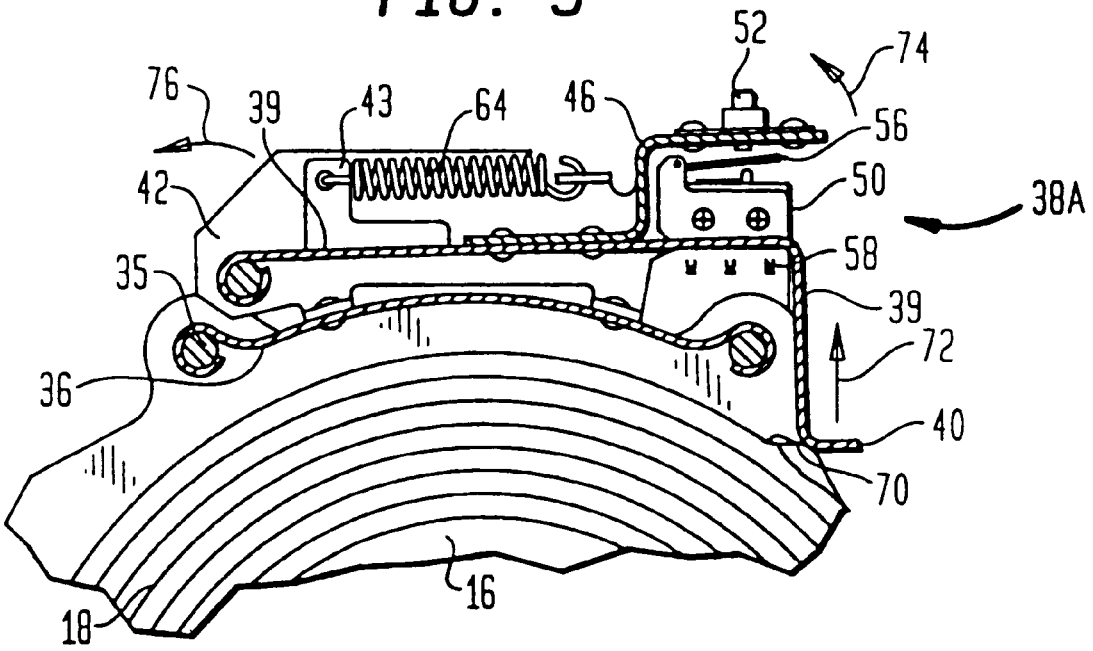
FIG. 5 is a view of the present invention in FIG. 3 being actuated by a cable foul.

Referring now also to FIGS. 3 and 5, the sensing finger 40 is angularly disposed such as shown in FIG. 3, to remain spaced approximately 1/16th" above an uppermost layer of the cable 18 when the cable 18 is fully wound on the drum 16. The sensing finger 40 extends along an entire length of the drum 16 below and in front of the cover 36. In FIG. 5, when the sensing finger 40 is moved upward in response to a cable foul 70, i.e. the cable 18 jumping, parting, or fouling thereof, the actuator strip 46 is forced upward to remove the force exerted pressure on the actuator plates 56A,56B. Either of the actuator plates 56A,56B, absent the pressure thereon, will permit the coacting spring loaded limit switches to move to the open position. The two UP stop switches and the two DOWN stop switches are all connected series. Opening of any one of these four switches will stop the drum. The drum 16 is immediately stopped due to the circuitry being "opened", and the brake is automatically applied to the drum 16, and a signal generated that such has occurred.

As shown in FIG. 5, arrows 72,74,76 indicate the pivotal direction that the sensing finger 40, flapper plate 39, and activator plate 56 undertake in response to a cable foul 70.

In those instances where there is fouling of the cable 18 at the drum 16, such as by excessive slack, jumping or splintering of the cable 18, the linear motion of the cable guide 28 will be impeded causing the cable 18 to quickly wind upon itself and build-up to a height sufficient to trip the sensing finger 40 of the flapper plate 39.

When power to the motor 30 is removed, the brake automatically slides into position to secure the drum 16. In addition, there is an automatic load control brake coacting with the drum 16 which is activated by the load on the cable 18. The automatic load control brake remains closed and will not open and permit the load to be moved by the cable 18 until the motor 30 is actually engaged to drive the drum 16. If the cable 18 were to back off, and the load is removed, the drum 16 immediately stops. The automatic load control brake in the drum 16 is released when there is an active, intentional driving of the drum 16 in a DOWN direction with the motor 30. Unless the drum 16 is driven by the motor, the drum 16 will not rotate in the DOWN direction to unreel the cable 18.

After the cable foul sensor device 10 has sensed and responded to a cable foul 70, even if the device 10 were to return to the original position as shown in FIGS. 1 and 3, the circuitry has already been opened, thereby requiring a manual RESET in order to actuate the cable drum 16. This RESET process insures that the return of the cable foul sensor device to the original position does not automatically engage the cable drum for rotation and further exacerbate the problem of the cable foul.

Due to the different temperatures and environments that the device will operate in, it is preferred that the spring loaded limit switches 58A,B–62A,B are hermetically sealed switches. Examples of such switches are miniature hermetically sealed single-pole, double-throw switches, such as model No. 11HM1 (MS27216-5) distributed by MICRO SWITCH, a division of the Honeywell Company.

A beginning portion of the cable 18 attached to the drum 16, and an end portion of the cable 18 at the hook 20 can be distinctly colored, such as red or international orange, to signify those particular regions of the cable 18.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. A cable foul sensor and winch assembly, comprising:

a winch housing;

a rotatable drum having a plurality of grooves formed along a surface of the rotatable drum;

a shaft connected to the housing and about which the rotatable drum turns;

a motor for driving the shaft;

a cable having a first end connected to the rotatable drum and extending to a second working end, the cable sized and shaped for a portion of the cable to be disposed in the plurality of grooves of the rotatable drum;

a level wind screw mounted to the housing in spaced, parallel relation with the rotatable drum for rotational movement in registration with the rotatable drum;

a cable guide mounted to the level wind screw for linear movement therealong, the cable guide adapted to guide the cable onto and off of the rotatable drum;

a hook attached to the second working end of the cable and being adapted for lifting objects;

a cover mounted to the housing and having ends extending to both sides of the drum;

a flapper plate pivotally mounted to the cover;

a sensing finger extending along the flapper plate toward the cable drum and terminating above an uppermost layer of the cable on the cable drum;

an actuating strip connected to the flapper plate for movement therewith;

an adjustable set screw extending through the actuating strip;

a switch assembly mounted to each end of the cover, each one of the switch assemblies having:

a plurality of spring-loaded hermetically sealed switches to control power to rotate the drum, and notifying of an interruption of power, a contact plate extending from each one of the switch assemblies and pivotally mounted thereto, the contact plate adapted to contact simultaneously the plurality of spring-loaded switches in the switch assembly and be moveable between a first position wherein the contact plate is urged by the set screw adjustably mounted to the actuating strip to contact and be positioned to coact with the plurality of spring-loaded switches, and a second position wherein the contact plate is not urged against the plurality of spring-load switches; and a spring having a stationary first end connected to the cover and a second end mounted to the flapper plate for biasing the actuating strip to urge the contact plate to maintain the switches in the closed position.

2. A cable sensor device for a cable used with a drum, comprising:

means for switching power to the drum;

displacement means for sensing fouling movement of the cable with respect to the drum, said displacement means being spaced from said cable and drum;

means for actuating the power switching means in response to movement of the displacement means;

means for tensioning the displacement means for sensing fouling to urge the means for actuating the switching means to a closed position to maintain sower to the drum; and means for adjusting the means for actuating the power switching means;

said means for tensioning said displacement means urging said displacement means toward said cable and drum during operation of said drum, said tensioning means being responsive to pivotal movement of said displacement means away from said cable upon occurrence of a cable foul to interrupt power to the drum.

3. The cable sensor device according to claim 2, wherein the power switching means comprises:

a plurality of switches disposed at each end of the drum adapted to interrupt power to the drum and signal an interruption of power.

4. The cable sensor device according to claim 2, wherein the displacement means comprises:

a longitudinal member pivotally mounted on and extending along an axis parallel to the axis of the drum, and a sensing finger extending and along the longitudinal member and terminating at a position spaced from the drum above the location of the cable during operation of the drum.

5. The cable sensor device according to claim 2, further comprising;

a housing for said drum;

a cover mounted to the housing over said drum and spaced apart from said drum;

said displacement means mounted on the cover of and extending along said drum.

6. The cable sensor device according to claim 2, wherein the means for actuating the power switching means, comprises:

an actuating strip mounted on the displacement means, a screw mounted on said actuating strip, a contact plate movably disposed between said set screw and said switch means.

7. The cable sensing device according to claim 2 wherein said displacement means includes a flapper plate, said drum having opposed ends, said flapper plate having opposed ends disposed proximate the ends of said drum, said cover having opposed ends proximate the ends of said drum, a plurality of switches disposed on said opposed ends of said flapper plate proximate each end of said drum, said switches at each end of said drum being actuated by relative movement of said flapper plate and displacement of said displacement means.

8. The cable sensing device according to claim 7, further comprising:

an actuating strip fixed to and extending the length of the flapper plate, said actuating strip extending above said switch means, and set screw means disposed in said actuating strip above said switch means to control the actuation of said switch means.

9. The cable sensing device according to claim 8, wherein said switch means comprises:

a plurality of switches to interrupt and establish power to said drum, a contact plate disposed between said switch means and said set screw means, said contact plate adapted to contact simultaneously all of said plurality of switches.

10. A cable sensor device for use with a switch assembly for a cable drum, comprising:

a cable drum;

displacement means positioned along said drum for sensing fouling movement of cable at the cable drum, said displacement means being urged toward and spaced from said drum and cable during operation of said drum and contacting said cable and being displaced therefrom by fouling movement of said cable; and a switch assembly mounted on said displacement means including means for actuating the switch assembly, the actuating means being movable between a first position during operation of said drum wherein the actuating means is urged against the switch assembly to connect power to said drum and a second position upon occurrence of said fouling movement wherein the actuating means is moved away from the switch assembly, the second position causing interruption of power to the cable drum and signalling said interruption.

11. The cable sensor device according to claim 10, further comprising:

tensioning means adapted to coact with the displacement means and the actuating means to tension the displacement means toward the drum and urge the actuating means to contact the switch assembly against vibrations at the drum during operation of said drum.

12. The cable sensor device according to claim 10, further comprising:

adjustment means mounted to the displacement means for adjusting contact of the actuating means with respect to the switch assembly.

13. The cable sensor device according to claim 10, wherein said switch assembly includes a plurality of switches, said actuating means simultaneously displacing all said switches at said switch assembly.

* * * * *